US010704181B2

(12) United States Patent
Lv et al.

(10) Patent No.: US 10,704,181 B2
(45) Date of Patent: Jul. 7, 2020

(54) LOCKING MECHANISM FOR INNER TUB OF WASHING MACHINE, AND WASHING MACHINE

(71) Applicant: QINGDAO HAIER WASHING MACHINE CO., LTD., Qingdao, Shandong (CN)

(72) Inventors: Peishi Lv, Shandong (CN); Lin Yang, Shandong (CN); Lingchen Wang, Shandong (CN); Yun Tian, Shandong (CN); Baozhen Cheng, Shandong (CN); Gangjin Zhang, Shandong (CN)

(73) Assignee: QINGDAO HAIER WASHING MACHINE CO., LTD., Qingdao, Shandong (CN)

( * ) Notice: Subject to any disclaimer, the term of this patent is extended or adjusted under 35 U.S.C. 154(b) by 323 days.

(21) Appl. No.: 15/548,568

(22) PCT Filed: Nov. 23, 2015

(86) PCT No.: PCT/CN2015/095294
§ 371 (c)(1),
(2) Date: Aug. 3, 2017

(87) PCT Pub. No.: WO2016/124036
PCT Pub. Date: Aug. 11, 2016

(65) Prior Publication Data

US 2018/0016730 A1 Jan. 18, 2018

(30) Foreign Application Priority Data

Feb. 4, 2015 (CN) ..... 2015 1 0057876

(51) Int. Cl.
*D06F 23/04* (2006.01)
*D06F 37/12* (2006.01)
(Continued)

(52) U.S. Cl.
CPC ..... *D06F 37/267* (2013.01); *D06F 23/04* (2013.01); *D06F 37/12* (2013.01); *D06F 37/42* (2013.01);
(Continued)

(58) Field of Classification Search
CPC ..... D06F 23/04; D06F 37/12; D06F 37/267; D06F 37/302; D06F 37/42; D06F 39/083
(Continued)

(56) References Cited

U.S. PATENT DOCUMENTS

2007/0216168 A1 9/2007 Farano et al.

FOREIGN PATENT DOCUMENTS

CN 2755140 Y 2/2006
CN 101008146 8/2007
(Continued)

OTHER PUBLICATIONS

International Search Report (PCT/ISA/210) dated Mar. 2, 2016, by the State Intellectual Property Office of the P.R. China as the International Searching Authority for International Application No. PCT/CN2015/095294.
(Continued)

*Primary Examiner* — Levon J Shahinian
(74) *Attorney, Agent, or Firm* — Buchanan Ingersoll & Rooney PC

(57) ABSTRACT

A first positioning structure is arranged at the bottom of the inner tub of a washing machine, and a second positioning structure is arranged at the bottom of the outer tub. When the two positioning structures come into concave-convex cooperation, the inner tub is locked; and when the two positioning structures separate from each other, the inner tub is unlocked. A locking hole is formed at the bottom of the inner tub; a stretchable and contractible locking rod is arranged at the bottom of the outer tub; when the locking rod projects
(Continued)

into the locking hole, the inner tub is locked; and when the locking rod separates from the locking hole, the inner tub is unlocked. During washing, the inner tub is locked without water between the inner tub and the outer tub.

17 Claims, 6 Drawing Sheets

(51) Int. Cl.

| | |
|---|---|
| ***D06F 37/26*** | (2006.01) |
| ***D06F 37/30*** | (2020.01) |
| ***D06F 37/42*** | (2006.01) |
| ***D06F 39/08*** | (2006.01) |

(52) U.S. Cl.
CPC ..... *D06F 39/083* (2013.01); *D06F 37/302* (2013.01)

(58) Field of Classification Search
USPC ..... 68/212; 292/89
See application file for complete search history.

(56) References Cited

FOREIGN PATENT DOCUMENTS

| | | | |
|---|---|---|---|
| CN | 101044277 | A | 9/2007 |
| EP | 1 798 323 | A1 | 6/2007 |
| GB | 2242444 | A | 10/1991 |
| JP | H03284294 | A | 12/1991 |
| JP | 2005-052538 | A | 3/2005 |
| JP | 2006000190 | A | 1/2006 |
| JP | 2012001070 | A | 1/2012 |

OTHER PUBLICATIONS

Written Opinion (PCT/ISA/237) dated Mar. 2, 2016, by the State Intellectual Property Office of the P.R. China as the International Searching Authority for International Application No. PCT/CN2015/095294.

Extended European Search Report dated Jan. 31, 2018 in corresponding European Patent Application No. 15880978-0-1018, 7 pages.

Office Action (Notice of Reasons for Refusal) dated Feb. 5, 2019 in corresponding Japanese Application No. 2017-540847, 10 pages.

Office Action (Notice of Reason for Refusal) dated May 21, 2018 in corresponding Korean Patent Application No. 10-2017-7023520, 11 pages.

LOCKING MECHANISM FOR INNER TUB OF WASHING MACHINE, AND WASHING MACHINE

FIELD OF THE INVENTION

The present disclosure relates to the field of washing machines, and in particular relates to a locking mechanism for an inner tub of a washing machine and the washing machine.

BACKGROUND OF THE INVENTION

In an existing pulsator washing machine, water-permeable holes are formed on an inner tub, and the inner tub serving as a washing tub is communicated with an outer tub serving as a water containing tub. While water filled between side walls of the inner tub and the outer tub is not engaged in washing, it's only water within the inner tub that really participates in washing, which results in great waste of water resources. In addition, too much water between the inner and outer tubs can also reduce the concentration of detergent/washing powder in the washing liquid. Meanwhile, as water flows into and out of the inner tub and the outer tub frequently there between, the area between the sidewalls of the inner tub and the outer tub becomes a space hiding contaminants after long-term use, and scale from tap water, free substances from the washing powder, cellulose from clothes, organics from the human body and dust and bacteria carried by the clothes are very liable to be retained between the sidewalls of the inner tub and the outer tub. Molds are generated and bred as a large amount of contaminants accumulating within the washing machine after a long time of use which cannot be removed effectively. If such contaminants invisible to a user are not removed, the bacteria will adhere to the clothes and contact the human body after washing next time, thereby causing the problem of cross infection.

Patent 200420107890.8 relates to a full-automatic washing machine, which mainly includes a box body, a washing and dewatering tub, a water containing tub and a driving device, wherein the water containing tub is installed outside the washing and dewatering tub and is fixedly connected with the box body. A sealing device is arranged between the bottom face of the inner wall of the water containing tub and the bottom face of the outer wall of the washing and dewatering tub, and a sealing cavity is formed in the sealing device. The outer sidewall of the washing and dewatering tub is provided with no through hole; the bottom of the washing and dewatering tub is provided with a discharge hole communicated with the sealing cavity; a first discharge hole communicated with a discharge pipe is formed on the water containing tub; and a drain valve is arranged on the discharge pipe. The water containing tub is fixedly connected with the box body through a hanger rod. One end of the hanger rod is connected with the inner wall on the upper end of the box body, and the other end of the hanger rod is connected with the outer wall of the water containing tub. After a long time of operation, however, abrasion and water leakage are likely to occur due to long-term operation of the sealing structure; and the service life can be shortened greatly in the case of poor water quality and high sand content, thus losing functions that it should have. Moreover, the washing machine is not suitable for use in situations with large washing capacity, thus resulting in poor reliability.

In view of the foregoing, the present disclosure is proposed disclosure.

SUMMARY OF THE INVENTION

An object of the present disclosure is to overcome the shortcomings of the prior art, and provide a locking mechanism for an inner tub of a washing machine to position and lock the inner tub.

Another object of the present disclosure is to overcome the shortcomings of the prior art, and provide a washing machine with the locking mechanism described above, with no water between the inner tub and an outer tub during washing.

To achieve the objects, the present disclosure adopts the following technical solutions. In locking mechanism for the inner tub of the washing machine, a first positioning structure is arranged at the bottom of the inner tub, and a second positioning structure is arranged at the bottom of the outer tub; the second positioning structure is a stretchable and contractible structure. When the first positioning structure and the second positioning structure come into concave-convex cooperation, the inner tub is locked; and when the first positioning structure and the second positioning structure separate from each other, the inner tub is unlocked.

A locking hole is formed at the bottom of the inner tub; at least a stretchable and contractible locking rod is arranged at the bottom of the outer tub; when the locking rod projects into the locking hole, the inner tub is locked; and when the locking rod separates from the locking hole, the inner tub is unlocked.

The locking mechanism further includes a fixed base for the locking rod; the fixed base, which is an annular structure, is fixed to the outer surface of the bottom of the outer tub; and a slideway is arranged at the center of the fixed base, and the valve rod is arranged in the slideway.

A mounting hole for the locking mechanism is formed at the bottom of the outer tub, and a stretchable and contractible sealing structure is arranged between the locking rod and the mounting hole. Preferably, the sealing structure is an annular seal ring, an inner circle of which is connected to the locking rod, and an outer circle of which is connected to the mounting hole. Further preferably, the annular seal ring is provided with a corrugated bend along a radial direction.

The locking mechanism further includes a fixed shell, which is matched with the mounting hole; the locking rod is arranged in the fixed shell. A sealing structure is arranged between the mounting hole and the fixed shell; and a sealing structure is arranged between the fixed shell and the locking rod.

A seal ring is arranged between the mounting hole and the fixed shell; the sealing structure between the fixed shell and the locking rod is a sealing sleeve that is stretchable and contractible along with stretching and contracting of the locking rod. A first end of the sealing sleeve is in sealed connection with the fixed shell, and a second end thereof is in sealed connection with the locking rod; and preferably, the sealing structure is in the shape of a corrugated pipe.

The first end of the sealing sleeve is in sealed connection with the upper end of the fixed shell, and the second end of the sealing sleeve extends axially to form a third end, which is in sealed connection with the lower end of the fixed shell. The extension part is a sealing sleeve that is stretchable and contractible along with stretching and contracting of the locking rod, and is preferably in the shape of a corrugated pipe.

A boss is provided at the upper part of the locking rod, and the second end of the sealing sleeve or the inner circle of the annular seal ring is connected to the boss.

A spring is sleeved outside the slideway of the locking rod; the spring is located between the boss of the locking rod and the fixed base. One end of the spring is in contact with the boss, and the other end is in contact with the fixed base; and when the locking rod moves downward, the spring is compressed.

The lower end of the locking rod is connected with a linear reciprocating motor, or the lower end of the locking rod is connected with a rotary motor through a connecting rod structure; and the motor is mounted in a housing which is provided with an installation part fixed to the bottom of the outer tub.

When the locking rod contracts to the lowest position, the top end of the locking rod is lower than or flush with the internal surface of the bottom of the outer tub; and preferably, when the locking rod contracts to the lowest position, the top end of the locking rod is flush with the internal surface of the bottom of the outer tub.

The locking hole is a blind hole formed in an inner tub flange, the inner tub flange is provided with a smooth groove on each of two sides in the circumferential direction of the locking hole respectively to form a guide rail; or the guide rail is a separate structure with a smooth groove formed on the guide rail, and the locking hole is located in the middle of the groove.

A plurality of axial bulges are uniformly distributed on the inner wall of the slideway along a circumferential direction, and the tops of the bulges are in contact with the external surface of the locking rod.

A washing machine with the above-mentioned locking mechanism is also provided.

After adopting the technical solutions of the present disclosure, the following beneficial effects are achieved:

1. In the present disclosure, there is no washing water between the inner tub and the outer tub, resulting in the characteristic of water conservation; and during draining and/or dewatering, the discharge hole is opened, and most water and deposits such as dirt and sand and particles are discharged via the discharge hole at the lower part to the outer tub, and water in the clothes is discharged via the discharge holes at the upper part of the inner tub to the outer tub during dewatering when the inner tub rotates at a high speed, and directly discharged out of the washing machine via a discharge port and a discharge pipe at the bottom of the outer tub. Thus achieving quick draining and good draining and contamination discharging effect.

2. The locking mechanism of the present disclosure can position and then lock the inner tub, and the discharge structure blocks the first discharge hole, which can also effectively prevent the inner tub from rotating when the washing machine is performing water intake and washing, and prevent the discharge structure from failure.

3. The locking mechanism of the present disclosure has good sealing performance to avoid water leakage from the outer tub, and is simple in structure to facilitate control, and reliable in operation and highly safe.

Specific embodiments of the present disclosure are further described in detail below in conjunction with the accompanying drawings.

Reference signs: 100—inner tub, 101—inner tub body, 102—bottom of inner tub, 103—inner tub flange, 104—balance ring, 105—first discharge hole, 106—second discharge hole, 200—outer tub, 201—first mounting hole, 202—bottom of outer tub, 203—outer tub discharge hole, 204—second mounting hole, 300—locking mechanism, 301—locking hole, 302—locking rod, 303—fixed base, 304—slideway, 305—fixed shell, 306—seal ring, 307—sealing sleeve, 308—first end, 309—second end, 310—third end, 320—boss, 321—spring, 322—connecting rod, 323—cam, 324—rotary motor, 325—guide rail, 326—bulge, 327—nut, 328—housing, 329—installation part, 400—discharge structure, 401—valve rod, 402—sealing sleeve, 403—barrier, 404—first end, 405—second end, 406—third end, 407—fixed base, 408—slideway, 409—fixed shell, 410—turnup, 411—leakage port, 412—discharge pipe, 413—spring, 414—connecting rod, 415—cam, 416—rotary motor, 417—housing, 418—installation part, 419—bulge, 420—fastening bolt.

DETAILED DESCRIPTION OF THE EMBODIMENTS

Figure 1:
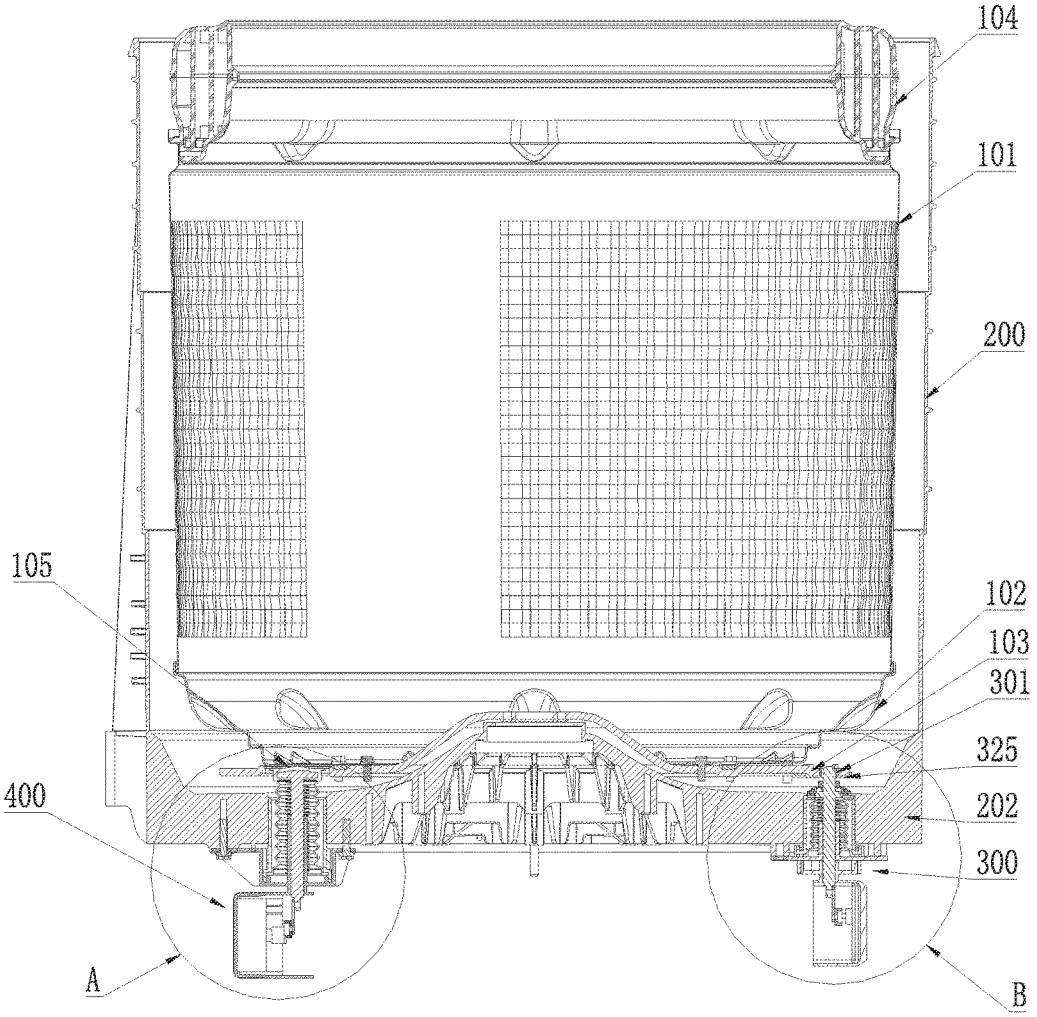
FIG. 1 is an installation structure diagram of a locking mechanism of the present disclosure.
Figure 2:
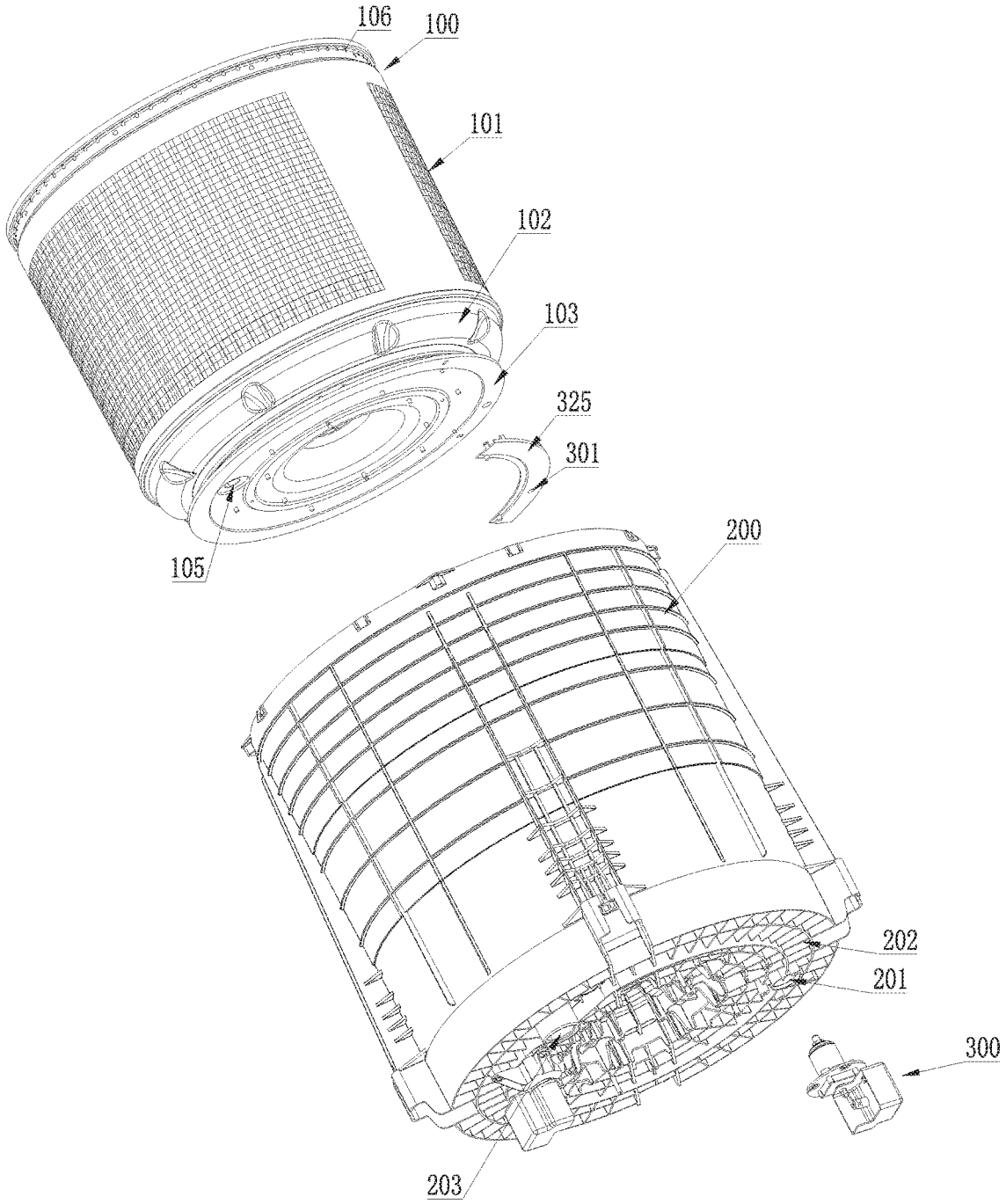
FIG. 2 is an installation structure exploded view of the locking mechanism of the present disclosure.

As shown in FIGS. 1 and 2, a water-saving washing machine includes an inner tub 100 and an outer tub 200. An inner tub body 101 has no leakage hole communicated with the outer tub. A first discharge hole 105 is formed at the bottom of the inner tub, and a circle of second discharge holes 106 are formed in a circle at the upper part of the inner tub 100. During washing, the first discharge hole 105 is closed, and water is only contained within the inner tub 100, and there is no water between the inner tub 100 and the outer tub 200. After the end of washing, the first discharge hole 105 is opened, and most water is discharged via the first discharge hole 105. During dewatering, the inner tub 100 rotates, and water released from clothes rises along the wall of the tub under the action of a centrifugal force, is discharged from the inner tub via the second discharge holes 106 at the upper part of the inner tub to the space between the inner tub and the outer tub, and then is drained via an outer tub discharge hole 203 of the outer tub 200. In this way, during washing, the washing water is only retained in the inner tub 100 and there is no water between the inner tub and the outer tub, resulting in the characteristic of water conservation. And during draining and/or dewatering, the first discharge hole 105 is opened, and most water and deposits such as dirt and sand and particles are discharged via the first discharge hole 105 at the lower part to the outer tub, and water in the clothes is discharged via the second discharge holes 106 at the upper part of the inner tub to the outer tub during dewatering when the inner tub rotates at a high speed, and directly discharged out of the washing machine via a discharge port and a discharge pipe at the bottom of the outer tub. Thus achieving quick draining and good draining and contamination discharging effect.

In the present disclosure, a discharge structure 400 for controlling the first discharge hole 105 to be opened/closed is arranged at the bottom of the first discharge hole 105. During water intake and washing, the discharge structure 400 controls the first discharge hole 105 to be closed. During draining and dewatering, the discharge structure 400 controls the first discharge hole 105 to be opened. Furthermore, a locking mechanism 300 is added to the bottom of the inner tub 100. The discharge structure 400 is arranged on the outer tub 200 and fixed circumferentially, and the first discharge hole 105 is formed on the inner tub 100. During dewatering, the inner tub rotates, and when the first discharge hole 105 needs to be closed by the discharge structure 400, they may be not necessarily at the same location, and the locking mechanism 300 first positions the inner tub such that the locations of the first discharge hole 105 and the discharge structure 400 correspond to each other, and then lock the inner tub 100, and the discharge structure 400 blocks the first discharge hole 105. The locking mechanism 300 can also effectively prevent the inner tub 100 from rotating when the washing machine is performing water intake and washing, and the discharge structure 400 for controlling the first discharge hole 105 to be opened/closed, at the bottom of the first discharge hole from failure.

A first positioning structure is arranged at the bottom of the inner tub, and a second positioning structure is arranged at the bottom of the outer tub. The second positioning structure is a stretchable and contractible structure. When the first positioning structure and the second positioning structure come into concave-convex cooperation, the inner tub is locked. When the first positioning structure and the second positioning structure separate from each other, the inner tub is unlocked.

Figure 3:
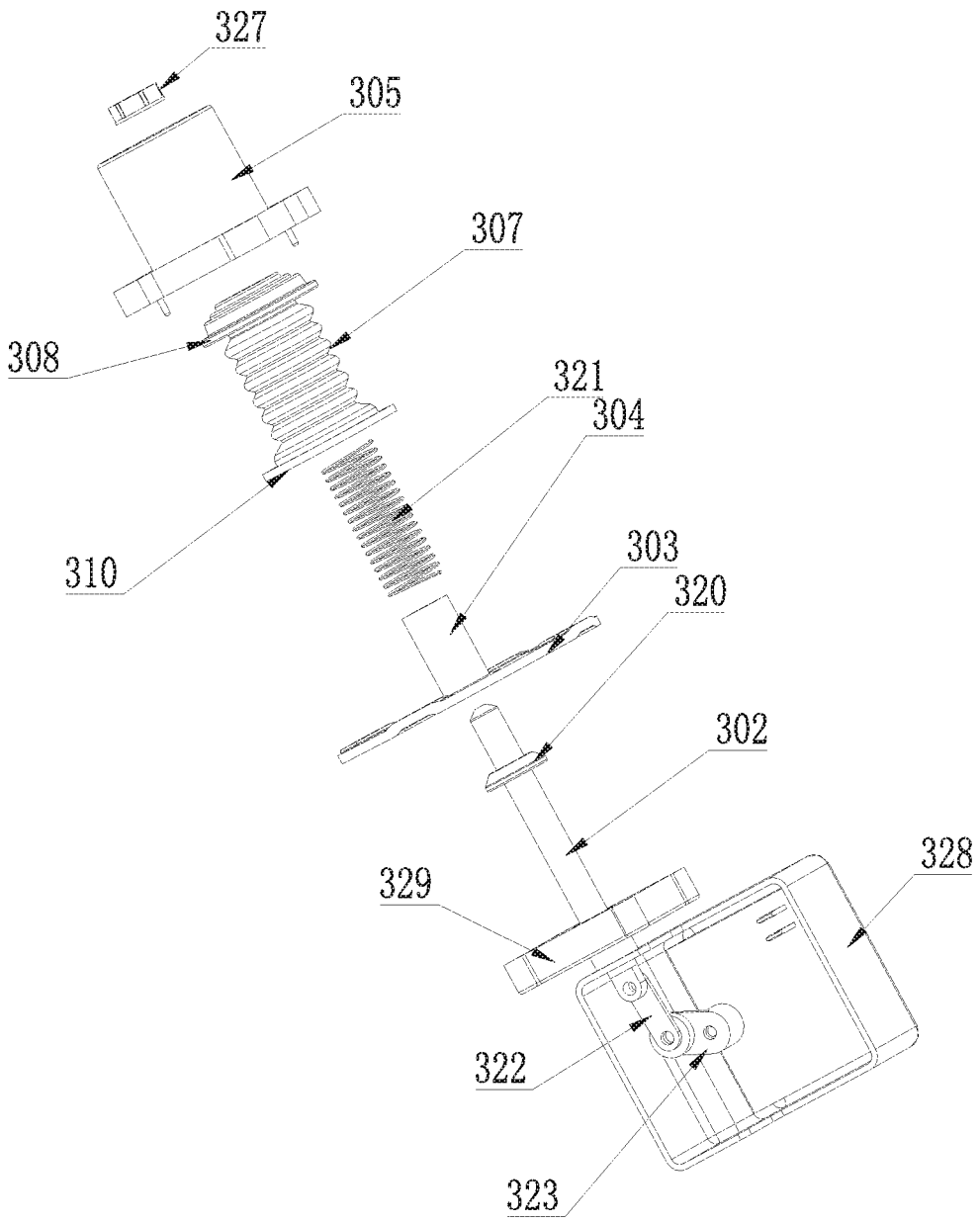
FIG. 3 is an exploded view of the locking mechanism of the present disclosure.
Figure 4:
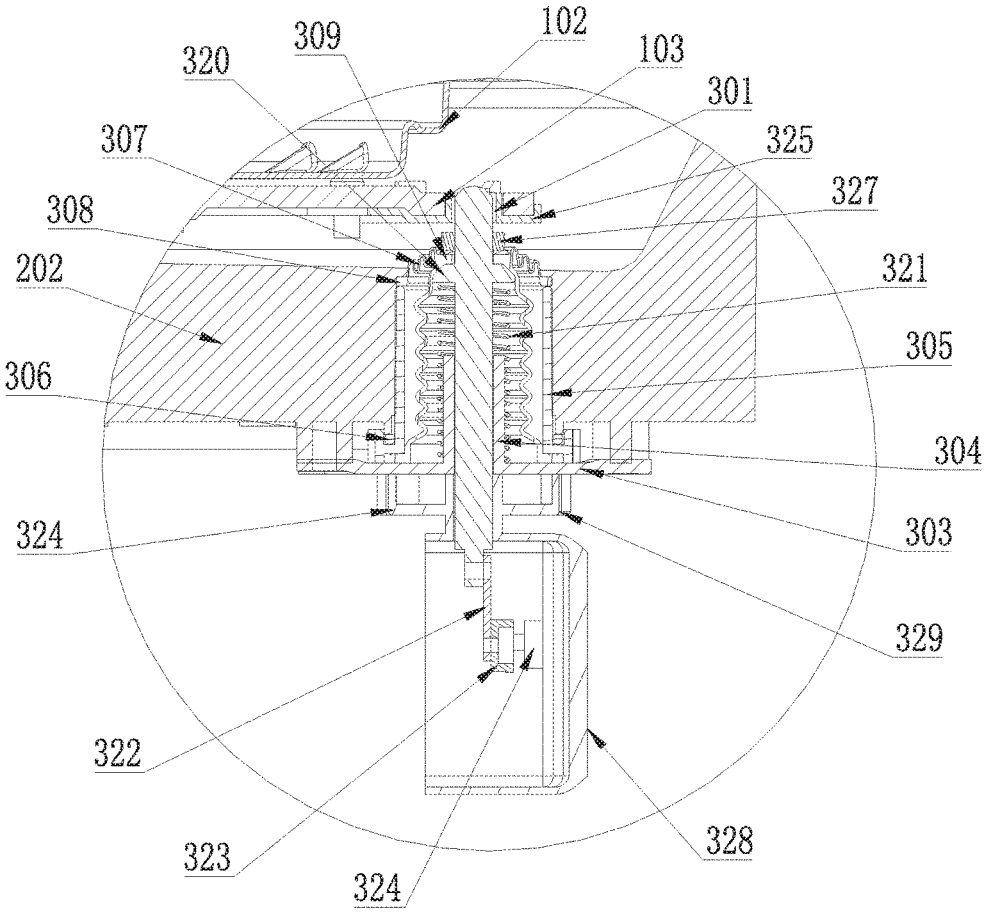
FIG. 4 is an enlarged view at B of FIG. 1.
Figure 5:
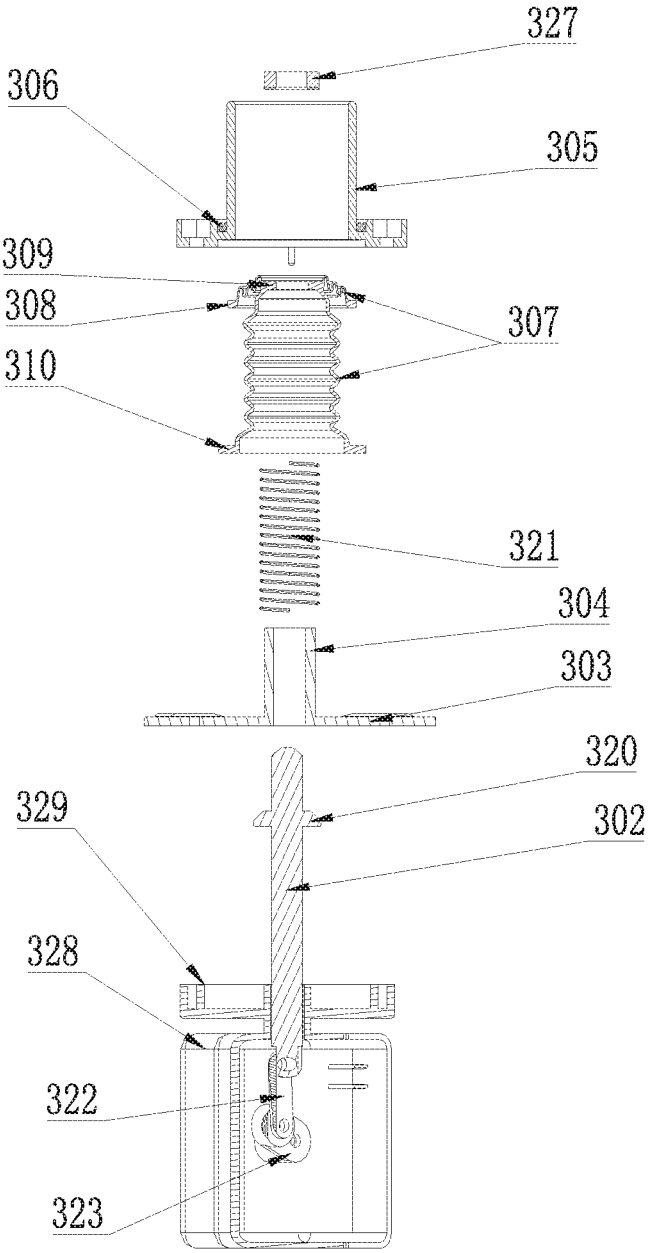
FIG. 5 is a sectional exploded view of the locking mechanism of the present disclosure.

FIGS. 3, 4 and 5 show the locking mechanism 300 for the inner tub of the washing machine of the present disclosure, wherein a locking hole 301 not communicated with the inner tub is formed at the bottom of the inner tub 100. The locking mechanism 300 is mounted at the bottom of the outer tub. The locking mechanism 300 at least includes a stretchable and contractible locking rod 302 which is fixed circumferentially. During washing and rinsing, the locking rod 302 moves upward and projects into the locking hole 301, and the inner tub 100 is locked and cannot rotate, to avoid failure of the discharge structure 400. During dewatering, the locking rod 302 moves downward and separates from the locking hole 301, and the inner tub 100 can rotate circumferentially to dewater the clothes therein. When the bottom of the inner tub 100 needs to be sealed, the locking rod 302 moves upward and projects into the locking hole 301 so that the inner tub 100 is locked, and the discharge structure 400 blocks the first discharge hole 105. When the inner tub 100 needs to rotate, the locking rod 302 moves downward and separates from the locking hole 301 so that the inner tub can rotate circumferentially, and the locking rod 302 moves downward to be flush with the inner bottom surface of the outer tub 200 and does not affect rotation of the inner tub 100.

A mounting hole for the locking mechanism is formed at the bottom of the outer tub, and a stretchable and contractible sealing structure is arranged between the locking rod and the mounting hole. Preferably, the sealing structure is an annular seal ring, an inner circle of which is connected to the locking rod, and an outer circle of which is connected to the mounting hole. Further preferably, the annular seal ring is provided with a corrugated bend along a radial direction.

The locking mechanism 300 is arranged at the bottom of the outer tub 200 and corresponds to the position of the locking hole. The locking mechanism 300 further includes a fixed base 303 for the locking rod 302. The fixed base 303, which is an annular structure, is fixed to the outer surface of the bottom of the outer tub 200, and a slideway 304 for the locking rod 302 is arranged at the center of the fixed base 303. The fixed base 303 is threaded connected and fixed to the outer side of the bottom of the outer tub 200 through bolts, screws or the like, and the slideway 304 for the locking rod 302 is arranged at the center of the fixed base 303. The locking rod 302 can slide in the slideway 304 to control locking and releasing of the inner tub.

Figure 7:
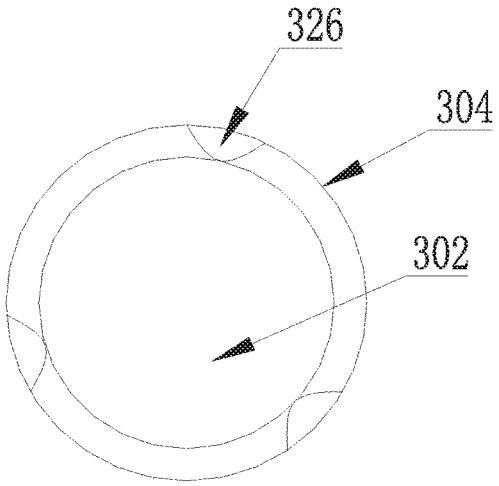
FIG. 7 is a schematic diagram of an assembly relation between a locking rod and a slideway.

As shown in FIG. 7, the slideway 304 has an inner diameter slightly greater than the outer diameter of the locking rod 302 with a clearance there between. The clearance should not be very small so as to ensure the locking rod 302 can slide freely in the slideway 304, and the clearance should not be very large so as to ensure the moving direction of the locking rod 302 does not deflect too much. A plurality of axial bulges 326 are uniformly distributed on the inner wall of the slideway 304 along a circumferential direction, and the tops of the bulges 326 are in linear contact with the surface of the locking rod 302. As such, the plurality of bulges 326 function to orient the locking rod 302 to ensure the locking rod is aligned to the locking hole and reduce swaying, and also reduce the contact area and friction, so that the locking rod 302 slides freely in the slideway 304.

A sleeve-like first mounting hole 201 is formed at the bottom of the outer tub 200. The locking mechanism 300 further includes a fixed shell 305, which is sleeve-like and arranged within the first mounting hole 201 and matched with the first mounting hole 201. The locking rod 302 is arranged in the fixed shell 305. A sealing structure is arranged between the first mounting hole 201 and the fixed shell 305, and a sealing structure is arranged between the fixed shell 305 and the locking rod 302. The sealing structures can ensure water leakage does not occur at the first mounting hole 201.

Preferably, the upper end of the first mounting hole 201 is bent inward to form a bend, and the lower end of the fixed shell is bent outward to form a bend. The fixed shell 305 projects into the first mounting hole 201, the upper end of the fixed shell 305 abutting against the bend at the upper end of the first mounting hole 201, with a sealing structure such as an elastic sealing ring arranged there between, and the lower end of the first mounting hole 201 abutting against the bend at the lower end of the fixed shell, with a sealing structure such as an elastic sealing ring arranged there between.

The sealing structure between the first mounting hole 201 and the fixed shell 305 is a round-shaped seal ring which is arranged between the first mounting hole 201 and the fixed shell 305. The sealing structure between the fixed shell 305 and the locking rod 302 is a sealing sleeve 307 that can stretch and contract along with stretching and contracting of the locking rod. A first end 308 of the sealing sleeve 307 is in sealed connection with the fixed shell 305, and a second end 309 thereof is in sealed connection with the locking rod 302. Preferably, the first end of the sealing sleeve 307 is arranged between the upper end of the fixed shell 305 and the bend at the upper end of the first mounting hole 201, so that the sealing sleeve with elasticity achieves sealing; and the second end of the sealing sleeve is in sealed connection with the locking rod 302, thus avoiding that water in the outer tub enters the fixed shell to cause damage to the locking mechanism 300 and result in water leakage. Preferably, the sealing structure is the sealing sleeve 307 in the shape of a corrugated pipe, being stretchable, non-permeable to water in itself, and capable of achieving sealing. The sealing sleeve is a sealing sleeve made of an elastic material, such as a rubber sleeve.

The first end 308 of the sealing sleeve 307 is in sealed connection with the upper end of the fixed shell 305, and the second end 309 of the sealing sleeve 307 extends axially to form a third end 310, which is in sealed connection with the lower end of the fixed shell 305. The extension part is a sealing sleeve that can stretch and contract along with stretching and contracting of the locking rod, and is preferably in the shape of a corrugated pipe. The extended sealing sleeve provides secondary sealing effect. Even if a problem occurs in the sealing described above, the extended sealing sleeve can also achieve further sealing function, thus improving the safety and avoiding water leakage.

Preferably, the fixed shell 305 is connected at the lower end to the fixed base, and then the fixed base is connected to the outer tub; the third end 310 of the sealing sleeve is located between the lower end of the fixed shell 305 and the fixed base; and the lower end of the fixed shell 305 and the fixed base squeeze the third end 310 to achieve sealing.

A boss 320 is provided at the upper part of the locking rod 302, and the second end 309 of the sealing sleeve is connected to the boss. The inner diameter of the second end 309 is slightly greater than the outer diameter of the locking rod 302. A side face of the second end 309 is tightly contact with the boss 320, and then they are fixed through a fastening nut 327. The boss 320 and the fastening nut 327 squeeze the second end 309 to achieve sealing.

A spring 321 is sleeved outside the slideway 304 of the locking rod 302. The spring 321 is located between the boss 320 of the locking rod 302 and the fixed base 303, one end of the spring 321 being in contact with the boss 320, and the other end being in contact with the fixed base 303. When the locking rod 302 moves downward, the boss 320 presses the spring 321 to move downward, so that the spring 321 is compressed. Moreover, the restoring force of the spring 321 can also drive the locking rod 302 to move upward.

The lower end of the locking rod 302 is connected with a linear reciprocating motor, and movement of the linear reciprocating motor drives the locking rod 302 to stretch and contract, or the movement of the linear reciprocating motor drives the locking rod 302 to move downward, and the restoring force of the spring 321 drives the locking rod 302 to move upward; or the lower end of the locking rod 302 is connected with a connecting rod 322, which is connected to a cam 323, and the cam 323 is connected with a rotary motor 234. The linear reciprocating motor or the rotary motor is mounted in a housing 328 to protect the motor and avoid water splashing to the motor to cause electric leakage, a fire and the like. The housing 328 is provided with an installation part 329 which is fixed to the bottom of the outer tub 200. The installation part 329 can be threaded connected and fixed, together with the fixed base 303 and the lower part of the fixed shell 305, to the bottom of the outer tub 200 through bolts, screws or the like.

When the locking rod 302 contracts to the lowest position, the top end of the locking rod 302 is lower than or flush with the internal surface of the bottom of the outer tub. Preferably, when the locking rod contracts to the lowest position, the top end of the locking rod is flush with the internal surface of the bottom of the outer tub. This can avoid that the locking rod 302 interferes with the inner tub 100 during rotation of the inner tub 100, to damage the locking rod 302 or the inner tub 100.

The locking hole 301 is formed in an inner tub flange 103, and the inner tub flange 103 is provided with a smooth groove on each of two sides in the circumferential direction of the locking hole 301 respectively to form a guide rail 325; or the guide rail 325 is a separate structure with a smooth groove formed on the guide rail 325, and the locking hole 301 is located in the middle of the groove. When the inner tub 100 rotates at a speed lower than a set rotating speed, the locking rod 302 is controlled to move upward and come into contact with the guide rail 325. Due to the action of the spring 321, the locking rod 302 still tends to move upward, and the inner tub rotates to generate friction with the guide rail 325 and the locking rod 302. When the locking hole 301 moves to the position of the locking rod 302 and corresponds to the locking rod 302, the locking rod moves upward and projects into the locking hole 301 to achieve positioning and locking of the inner tub 100.

Figure 6:
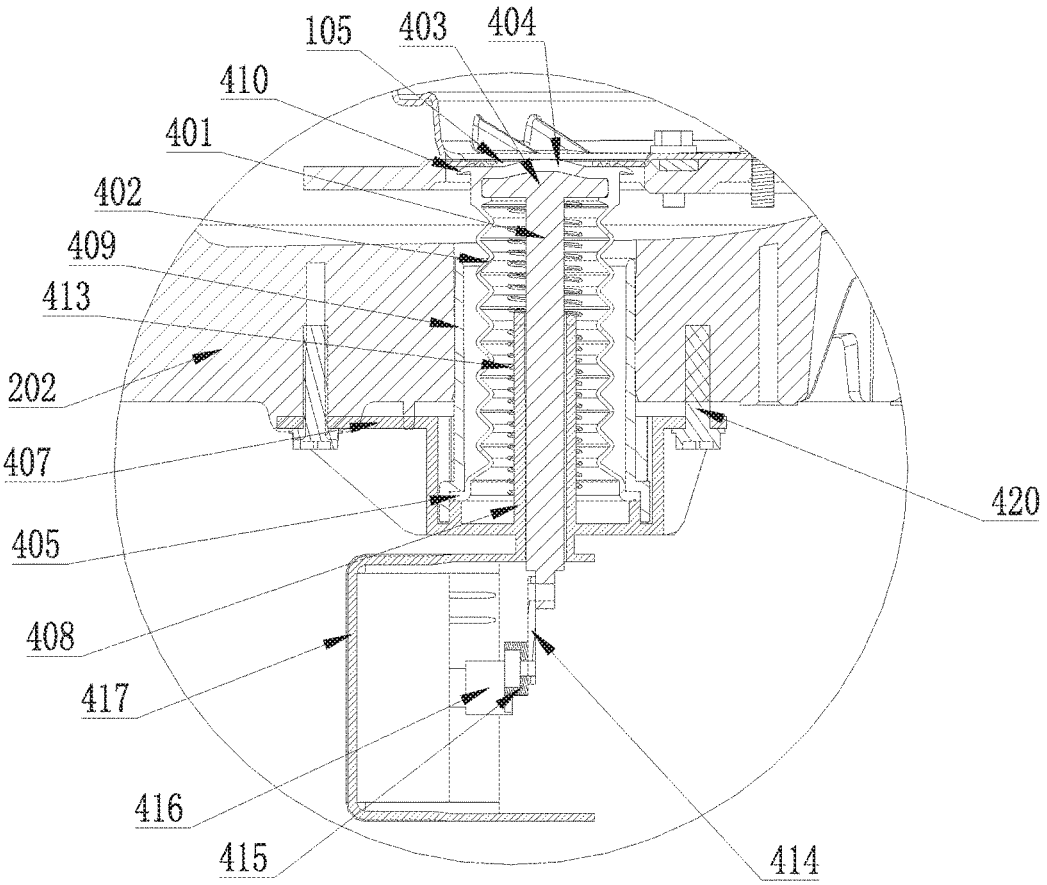
FIG. 6 is an enlarged view at A of FIG. 1.

FIG. 6 show the discharge control structure 400 for the water-saving inner washing tub without a hole of the present disclosure, wherein the first discharge hole 105 is formed at the bottom of the inner tub 100, and the discharge control structure 400 is mounted at a position at the bottom of the outer tub 200 corresponding to the first discharge hole 105. The discharge control structure 400 at least includes a stretchable and contractible valve plug, which is fixed in a circumferential direction. When the valve plug moves upward and covers the first discharge hole 105, the first discharge hole 105 is controlled to be closed. When the valve plug moves downward and separates from the first discharge hole 105, the first discharge hole 105 is controlled to be opened.

A second mounting hole 204 for the valve plug is formed at the bottom of the outer tub 200, and the second mounting hole 204 is in a sleeve shape. The valve plug includes a stretchable and contractible valve rod 401 and a sealing sleeve 402 stretchable with the valve rod. A barrier 403 capable of blocking the discharge hole is arranged at the top of the valve rod 401, and preferably the valve rod 401 is a T-shape structure.

A first end 404 of the sealing sleeve 402 is a sealed structure sleeved on the top of the valve rod 401, and a second end 405 of the sealing sleeve 402 is in sealed connection with the second mounting hole 204. Preferably, the sealing sleeve 402 is in the shape of a corrugated pipe. The valve rod 401 drives the sealing sleeve 402 to move upward to the first discharge hole 105, and the barrier 403 squeezes the second end of the sealing sleeve 402 to tightly contact to the first discharge hole 105, thereby blocking the first discharge hole 105. Preferably, the upper surface of the barrier 403 is an upward bulging spherical structure to achieve good sealing effect. The sealing sleeve is a sealing sleeve made of an elastic material, such as a rubber sleeve.

The discharge control structure 400 further includes a fixed base 407, which is fixed to an outer face of the bottom of the outer tub 200, and the center of the fixed base 407 is bent upward and/or downward to form a slideway 408 for the valve rod 401. The fixed base 303 is threaded connected and fixed to the outer side of the bottom of the outer tub 200 through bolts, screws or the like. The slideway 408 for the valve rod 401 is arranged at the center of the fixed base 407, and the valve rod 401 can slide in the slideway 408 to control opening and closing of the first discharge hole 105 of the inner tub.

The slideway 408 is sleeve-like, having an inner diameter slightly greater than the outer diameter of the valve rod 401 with a clearance there between. The clearance should not be very small so as to ensure the valve rod 401 can slide freely in the slideway 408, and the clearance should not be very large so as to ensure the moving direction of the valve rod 401 does not deflect too much. A plurality of axial bulges 419 are uniformly distributed on the inner wall of the slideway 408 along a circumferential direction, and the tops of the bulges 419 are in linear contact with the surface of the valve rod 401. As such, the plurality of bulges 419 function to orient the valve rod 401 to ensure the valve plug is aligned to the first discharge hole and avoid swaying, and also reduce the contact area and friction, so that the valve rod 401 slides freely in the slideway 408.

The discharge control structure 400 further includes a fixed shell 409. The fixed shell 409 is sleeve-like and disposed within the second mounting hole 204 and matched with the second mounting hole 204. The valve plug is arranged in the middle part of the fixed shell 409. The second end 405 of the sealing sleeve 402 is in sealed connection with the lower end of the fixed shell 409 or the lower end of the second mounting hole 204. The fixed shell 409 is fixed directly to the bottom of the outer tub 200 or the fixed shell 409 fixed to the bottom of the outer tub 200 through the fixed base 407.

Preferably, the upper end of the second mounting hole 204 is bent inward to form a bend, and the lower end of the fixed shell 409 is bent outward to form a bend. The fixed shell 409 projects into the second mounting hole 204, with the upper end of the fixed shell 409 abutting against the bend at the upper end of the second mounting hole 204, and the lower end of the second mounting hole 204 abutting against the bend at the lower end of the fixed shell 409. And the second end 405 of the sealing sleeve 402 is squeezed between the lower end of the second mounting hole 204 and the bend at the lower end of the fixed shell 409 to achieve sealing and avoid water leakage therefrom.

An outer edge of the first end 404 of the sealing sleeve 402 extends outward to form a turnup 410, the diameter of which is greater than the diameter of the fixed shell 409. After the valve plug moves downward and the discharge hole is opened, the turnup 410 is lapped on the upper end of the fixed shell 409 or the second mounting hole 204. When the valve plug moves downward and separates from the first discharge hole 105, water in the inner tub 100 immediately flows out downward. After flowing to the upper end, i.e. the first end 404, and the turnup 410 of the valve plug, the water is directed by the turnup 410 and spread to the periphery of the valve plug, which to avoid the water flow directly rushes into the fixed shell and causes impact on the discharge control structure. When the valve plug is located at the lowest position, the turnup 410 is lapped on the upper end of the fixed shell 409 or the second mounting hole 204, which can prevent impurities such as lint in the water flow from entering the fixed shell to obstruct stretching and contracting of the valve plug.

A leakage port 411 is provided at the lower part of the fixed shell 409, and a discharge pipe 412 is arranged at the leakage port 411 and connected to a discharge pipeline of the washing machine. As the sealing sleeve 402 is sleeved on the valve rod 401, and the second end 405 of the sealing sleeve 402 is sealed to the fixed shell 409, the water flow cannot be entirely blocked by the turnup 410 from entering the space between the fixed shell 409 and the sealing sleeve 402. With the leakage port 411, the water in the space can be discharged via the leakage port 411 to the discharge pipeline of the washing machine, thereby being drained out of the washing machine.

Preferably, an outer edge of the first end 404 of the sealing sleeve 402 extends outward to form a third end 406, which is in sealed connection with the fixed shell 409 or the upper end of the second mounting hole 204. The extension part is a sealing sleeve that can stretch and contract along with stretching and contracting of the valve rod, and is preferably sealing sleeve in the shape of a corrugated pipe. The sealing sleeve between the extended third end 406 and the first end 404 can seal the space between the fixed shell 409 and the sealing sleeve 402, to avoid water flow enters the space between the fixed shell 409 and the sealing sleeve 402. In this case, the sealing sleeve between the second end 405 and the first end 404 can be omitted. However, it is preferred to provide the sealing sleeve between the second end 405 and the first end 404, in order to ensure safety or prevent failure of the sealing sleeve between the third end 406 and the first end 404. In this case, the leakage port 411 does not need to be provided at the lower part of the fixed shell 409 since the space between the fixed shell 409 and the sealing sleeve 402 is sealed.

A spring 413 is sleeved outside the slideway 408 of the valve rod 401. The spring 413 is located between the barrier 403 of the valve rod 401 and the fixed base 407, with one end of the spring 413 being in contact with the barrier 403, and the other end being in contact with the fixed base 407. When the valve rod moves downward, the barrier 403 presses the upper end of the spring to move downward, so that the spring 413 is compressed. Moreover, the restoring force of a spring 321 can also cause the valve rod 401 to move upward. Furthermore, the compression amount of the spring can be set so that an upward force is also provided to the valve rod 401 when the discharge control structure 400 abuts against the first discharge hole 105.

The lower end of the valve rod 401 is connected with a linear reciprocating motor, and movement of the linear reciprocating motor drives the valve rod 401 to stretch and contract, or the movement of the linear reciprocating motor drives the valve rod 401 to move downward, and the restoring force of the spring 413 drives the valve rod 401 to move upward; or the lower end of the valve rod 401 is connected with a connecting rod 414, which is connected to a cam 415, and the cam 415 is connected with a rotary motor 416. The linear reciprocating motor or the rotary motor is mounted in a housing 417 to protect the motor and avoid water splashing to the motor to cause electric leakage, a fire and the like. The housing 417 is provided with an installation part 418 which is fixed to the bottom of the outer tub, or the housing 417 and the slideway 408 are integrally formed, i.e. the lower end of the slideway 408 is bent outward and then bent downward to form the housing 417.

Described above are only preferred embodiments of the present disclosure, and it should be noted that to those of ordinary skill in the art, various modifications and improvements may also be made without departing from principles of the present disclosure, and these modifications and improvements should also be encompassed within the protection scope of the present disclosure.

The invention claimed is:

1. A locking mechanism for an inner tub of a washing machine, comprising:

a locking rod, wherein the locking rod is configured for stretch and contraction and is arranged at a bottom of an outer tub of the washing machine;

a locking hole formed at a bottom of the inner tub for cooperating with the locking rod to lock the inner tub, wherein when the locking rod projects into the locking hole, the inner tub is locked and when the locking rod separates from the locking hole, the inner tub is unlocked;

a mounting hole for the locking mechanism is formed at the bottom of the outer tub; and a first sealing structure configured for stretch and contraction is arranged between the locking rod and the mounting hole.

2. The locking mechanism for the inner tub of the washing machine according to claim 1, wherein the locking mechanism further comprises a fixed base for the locking rod; the fixed base, which is an annular structure, is fixed to an outer surface of the bottom of the outer tub; and a slideway is arranged at a center of the fixed base, and a valve rod is arranged in the slideway.

3. The locking mechanism for the inner tub of the washing machine according to claim 1, wherein the locking mechanism further comprises a fixed shell, which is matched with the mounting hole; the locking rod is arranged in the fixed shell; a second sealing structure is arranged between the mounting hole and the fixed shell; and a third sealing structure is arranged between the fixed shell and the locking rod.

4. The locking mechanism for the inner tub of the washing machine according to claim 3, wherein a seal ring is arranged between the mounting hole and the fixed shell; the third sealing structure between the fixed shell and the locking rod is a sealing sleeve that is stretchable and contractible along with stretching and contracting of the locking rod; a first end of the sealing sleeve is in sealed connection with the fixed shell, and a second end of the sealing sleeve is in sealed connection with the locking rod.

5. The locking mechanism for the inner tub of the washing machine according to claim 4, wherein the first end of the sealing sleeve is in sealed connection with an upper end of the fixed shell, and the second end of the sealing sleeve extends axially to form a third end, and the third end is in sealed connection with a lower end of the fixed shell; an extension part is a sealing sleeve that is stretchable and contractible along with stretching and contracting of the locking rod.

6. The locking mechanism for the inner tub of the washing machine according to claim 5, wherein the extension part is in the shape of a corrugated pipe.

7. The locking mechanism for the inner tub of the washing machine according to claim 4, wherein the third sealing structure is in a shape of a corrugated pipe.

8. The locking mechanism for the inner tub of the washing machine according to claim 1, wherein a boss is provided at an upper part of the locking rod, and the second end of the sealing sleeve or an inner circle of the annular seal ring is connected to the boss.

9. The locking mechanism for the inner tub of the washing machine according to claim 1, wherein a spring is sleeved outside the slideway of the locking rod; the spring is located between a boss of the locking rod and the fixed base, and one end of the spring is in contact with the boss, and the other end is in contact with a fixed base; and when the locking rod moves downward, the spring is compressed.

10. The locking mechanism for the inner tub of the washing machine according to claim 1, wherein a lower end of the locking rod is connected with a linear reciprocating motor, or the lower end of the locking rod is connected with a rotary motor through a connecting rod structure; and the linear reciprocating motor or the rotary motor is mounted in a housing, the housing is provided with an installation part, the installation part is fixed to the bottom of the outer tub.

11. The locking mechanism for the inner tub of the washing machine according to claim 1, wherein when the locking rod contracts to a lowest position, a top end of the locking rod is lower than or flush with an internal surface of the bottom of the outer tub.

12. The locking mechanism for the inner tub of the washing machine according to claim 11, wherein when the locking rod contracts to the lowest position, the top end of the locking rod is flush with the internal surface of the bottom of the outer tub.

13. The locking mechanism for the inner tub of the washing machine according to claim 1, wherein the locking hole is a blind hole formed in an inner tub flange, the inner tub flange is provided with a smooth groove on each of two sides in a circumferential direction of the locking hole respectively to form a guide rail; or the guide rail is a separate structure with a smooth groove formed on the guide rail, and the locking hole is located in a middle of the groove.

14. The locking mechanism for the inner tub of the washing machine according to claim 1, wherein a plurality of axial bulges are uniformly distributed on an inner wall of the slideway along a circumferential direction, and tops of the bulges are in contact with an external surface of the locking rod.

15. A washing machine with the locking mechanism according to claim 1.

16. The locking mechanism for the inner tub of the washing machine according to claim 1, wherein the first sealing structure is an annular seal ring, an inner circle of the annular seal ring is connected to the locking rod, and an outer circle of the annular seal ring is connected to the mounting hole.

17. The locking mechanism for the inner tub of the washing machine according to claim 1, wherein the annular seal ring is provided with a corrugated bend along a radial direction.

* * * * *